US010337143B2

(12) United States Patent
Lu

(10) Patent No.: US 10,337,143 B2
(45) Date of Patent: Jul. 2, 2019

(54) AUTOMATICALLY COLOR MIX DYEING PROCESS

(71) Applicant: Grand Textile Co., Ltd., New Taipei (TW)

(72) Inventor: Jen-Huan Lu, New Taipei (TW)

(73) Assignee: Grand Textile Co., Ltd., New Taipei (TW)

( * ) Notice: Subject to any disclaimer, the term of this patent is extended or adjusted under 35 U.S.C. 154(b) by 19 days.

(21) Appl. No.: 15/871,189

(22) Filed: Jan. 15, 2018

(65) Prior Publication Data

US 2018/0223476 A1 Aug. 9, 2018

Related U.S. Application Data

(63) Continuation-in-part of application No. 15/428,478, filed on Feb. 9, 2017, now abandoned.

(51) Int. Cl.

| | |
|---|---|
| ***D06P 7/00*** | (2006.01) |
| ***D06C 5/00*** | (2006.01) |
| ***D06B 1/02*** | (2006.01) |
| ***D06B 3/04*** | (2006.01) |
| ***D06B 3/10*** | (2006.01) |
| ***D06B 3/24*** | (2006.01) |
| ***D06B 17/00*** | (2006.01) |
| ***D06B 19/00*** | (2006.01) |
| ***D06B 23/20*** | (2006.01) |
| ***D06B 23/24*** | (2006.01) |
| ***D04G 5/00*** | (2006.01) |
| ***D06P 1/00*** | (2006.01) |
| ***D06B 11/00*** | (2006.01) |

(52) U.S. Cl.

CPC ..... *D06P 7/00* (2013.01); *D04G 5/00* (2013.01); *D06B 1/02* (2013.01); *D06B 3/045* (2013.01); *D06B 3/105* (2013.01); *D06B 3/24* (2013.01); *D06B 11/005* (2013.01); *D06B 11/0073* (2013.01); *D06B 17/00* (2013.01); *D06B 19/0035* (2013.01); *D06B 23/205* (2013.01); *D06B 23/24* (2013.01); *D06C 5/00* (2013.01); *D06P 1/0096* (2013.01); *D06B 2700/10* (2013.01); *D06B 2700/35* (2013.01); *D10B 2403/033* (2013.01)

(58) Field of Classification Search

CPC ..... D06P 7/00; D06P 1/0096; D06C 5/00; D06B 1/02; D06B 3/045; D06B 3/105; D06B 3/24; D06B 17/00; D06B 19/0035; D06B 23/205; D06B 23/24; D06B 11/005; D06B 11/0073; D06B 2700/10; D06B 2700/35; D04G 5/00; D10B 2403/033

See application file for complete search history.

(56) References Cited

U.S. PATENT DOCUMENTS

| | | | |
|---|---|---|---|
| 7,333,201 B1 | 2/2008 | Fernadez et al. | |
| 2005/0106355 A1 | 5/2005 | Kohlman et al. | |

FOREIGN PATENT DOCUMENTS

| | | | | |
|---|---|---|---|---|
| CN | 101385608 A | | 3/2009 | |
| CN | 104818626 | * | 8/2015 | ..... D06B 1/02 |

* cited by examiner

*Primary Examiner* — Amina S Khan

(57) ABSTRACT

An automatic color mix dyeing process includes activating an automatic shaping device to shape an undyed object as a cylinder and tightening same; conveying the undyed object to a dyeing apparatus by means of spraying wherein the dyeing apparatus includes rows of spray devices, dye containers for containing dyes of different colors, each dye container being in fluid communication with the row of spray devices, a pump for moving the dyes in the dye containers to the rows of spray devices, and a control device for controlling the rows of spray devices to control a spray sequence, a spray time, and a spray quantity of dye; conveying the dyed object from the dyeing apparatus to a vapor device for color fixing wherein the dyed object is impregnated with hot vapor to obtain a finished object; cutting the tie ropes; and conveying, washing and drying the finished object.

13 Claims, 5 Drawing Sheets

AUTOMATICALLY COLOR MIX DYEING PROCESS

BACKGROUND OF THE INVENTION

1. Field of the Invention

The invention relates to textile dyeing and more particularly to a dyeing process tied to a dyeing apparatus and a vapor device so that an undyed object such as one of strands of yarn, pieces of fabric, and garments can be dyed with different colors in one process.

2. Description of Related Art

Conventional dyeing processes include twisting dyeing (or cutting dyeing) for strands of yarn, bundle dyeing for fabric, and hanging dyeing for garments. The conventional dyeing processes are characterized by mixing dyes and water to form a solution in a tank, and immersing an undyed textile material in the tank for dyeing.

However, the conventional dyeing processes have the following disadvantages: The textile material is limited to cotton not polyester, nylon, etc. because only cotton can be dyed in a low temperature step and polyester and nylon are required to dye in a high temperature step. Only one color can be dyed on the textile material in one process. That is, a plurality of processes are required if multi-color textile products are desired. However, it can complicate the manufacturing process. Large quantity of water is required in the dyeing process. The used dye solution is harmful to the environment if sufficient treatment is not done prior to discharge.

Thus, the need for improvement still exists.

SUMMARY OF THE INVENTION

It is therefore one object of the invention to provide an automatic color mix dyeing process comprising the steps of activating an automatic shaping device to shape an undyed object as a cylinder and tightening same wherein the automatic shaping device has a spooling device configured to open or close and an automatic tying device; opening the spooling device to place the undyed object therein; passing the undyed object through the spooling device to shape as a cylinder; conveying the undyed object to the automatic tying device by a conveyor wherein the automatic tying device has a plurality of tie ropes controlled by a control device to tie the cylindrical undyed object in different intervals; conveying the shaped undyed object to a dyeing apparatus for dyeing by means of spraying wherein the dyeing apparatus includes a plurality of rows of spray devices, a plurality of dye containers for containing dyes of different colors, each dye container being in fluid communication with the row of spray devices, a pump for moving the dyes in the dye containers to the rows of spray devices, and the control device for controlling the rows of spray devices to control a spray sequence, a spray time, and a spray quantity of dye; conveying the dyed object from the dyeing apparatus to a vapor device for color fixing wherein the dyed object is impregnated with vapor of 110-160° C. in the vapor device for 5-10 minutes to obtain a finished object; conveying the finished object to a tie ropes removing device to cut the tie ropes; and conveying the finished object to a temporary storage device; wherein the plurality of rows of spray devices of the dyeing apparatus are able to simultaneously spray and dye on the undyed object to form multiple color mix patterns thereon in one dyeing process.

Preferably, after the step of conveying the finished object to a temporary storage device, further comprise the steps of washing and drying the finished object.

Preferably, the washing step is done by washing the finished object with a washing device to remove dyes left on surfaces of the finished object.

Preferably, the undyed object is one of strands of yarn, pieces of fabric, and garments.

Preferably, the control device includes a plurality of controllers, each for controlling the row of spray devices to control the spray sequence, the spray time, and the spray quantity of dye.

Preferably, the number of the rows of spray devices is six, and each row of spray devices has seven spray devices.

Preferably, a length from the dyeing apparatus to the temporary storage device via the vapor device along the conveyor is in the range between 15-20 meters.

Preferably, the rows of spray devices are spaced apart by a predetermined distance, and the distance is adjustable by the control device.

The invention has the following advantages and benefits in comparison with the conventional art:

The vapor device can impregnate the dyed object with vapor in a high temperature or low temperature step. For example, the dyed object is impregnated with vapor of 110-160° C. in the vapor device depending on the object such as strands of yarn, pieces of fabric, and garments. Specifically, the strands of yarn are of a material such as polyester, nylon, cotton, rayon, acrylic, or wool.

The dyeing apparatus comprises the control device including a plurality of controllers, each for controlling the row of spray devices to control the spray sequence, the spray time, and the spray quantity of dye. Thus, different colors can be dyed on the object to form different patterns thereon in one dyeing process, i.e., yield is increased.

The spray device can spray dyes on the undyed object and the vapor device can impregnate the dyed object with vapor to obtain a finished object. No water is used in the dyeing process. Thus, water cost is greatly decreased and it is environmentally friendly.

The above and other objects, features and advantages of the invention will become apparent from the following detailed description taken with the accompanying drawings.

DETAILED DESCRIPTION OF THE INVENTION

Figure 1:
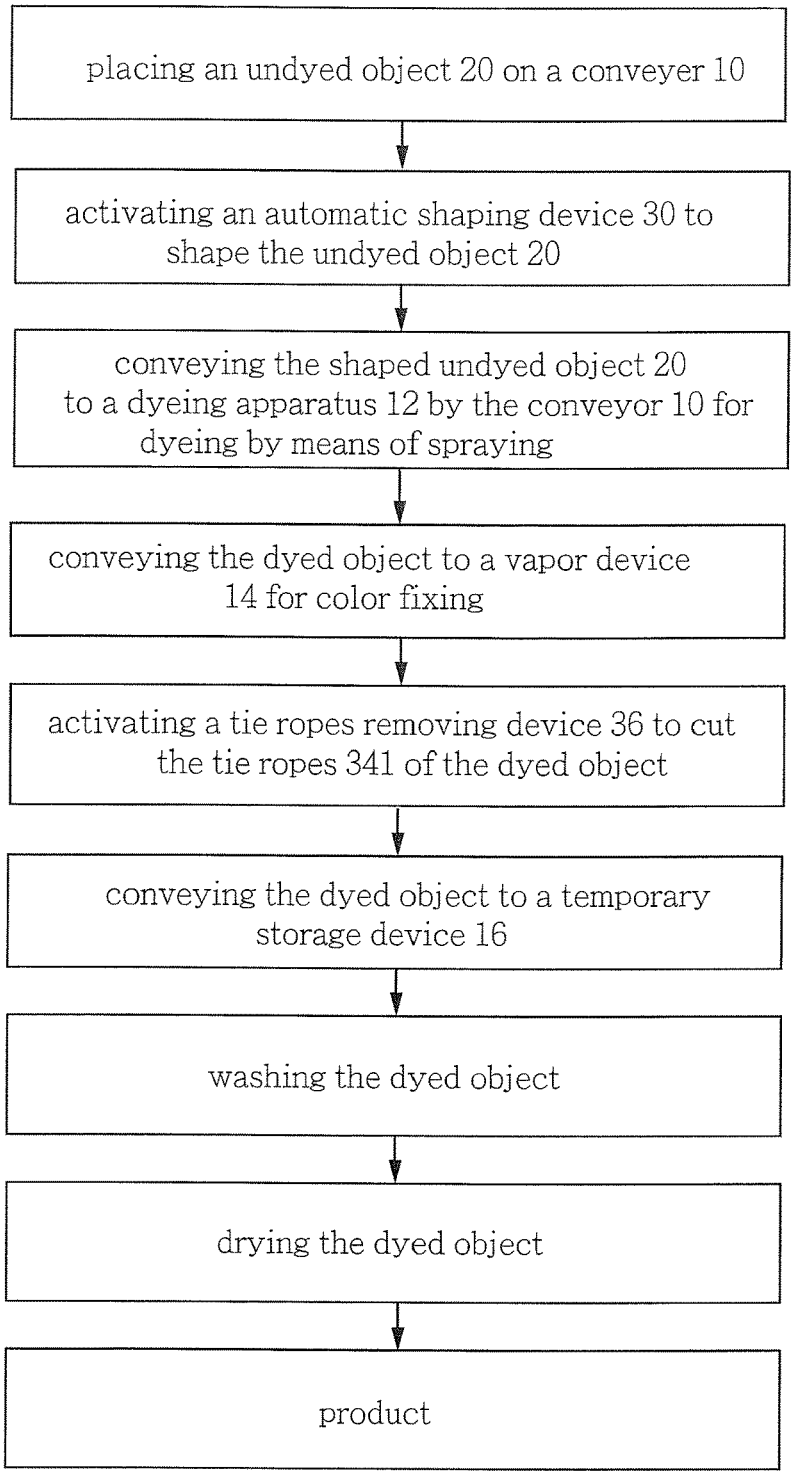
FIG. 1 is a flow chart of a dyeing process according to the invention.

Referring to FIG. 1 to FIG. 5, a dyeing process and a dyeing apparatus in accordance with the invention are illustrated. The dyeing process comprises the following steps:

Placing an undyed object 20 on a conveyor 10.

Activating an automatic shaping device 30 to shape the undyed object 20 as a cylinder and tightening same wherein the automatic shaping device 30 has a spooling device 32 configured to open or close and an automatic tying device 34.

Opening the spooling device 32 to place the undyed object 20 therein.

Adjusting a diameter of the spooling device 32 to tighten or loosen the undyed object 20.

Passing the undyed object 20 through the spooling device 32 to shape as a rope or cylinder.

Conveying the undyed object 20 to the automatic tying device 34 by the conveyor 10 wherein the automatic tying device 34 has a plurality of tie ropes 341 controlled by a control device 11 to tie the undyed object 20 in a interval of 5 to 20 cm, thereby fastening the flexibly shaped undyed object 20; and the tie ropes 341 have different shapes and widths between 5 and 10 cm so that after dying the undyed object 20 different stripes are formed thereon, thereby forming different colors and patterns.

Conveying the shaped undyed object 20 to a dyeing apparatus 12 by the conveyor 10 for dyeing by means of spraying. The dyeing apparatus 12 includes a plurality of rows of spray devices 121, a plurality of dye containers 122 for containing dyes of different colors, each dye container 122 being in fluid communication with the row of spray devices 121, a pump 123 for moving dyes in the dye containers 122 to the rows of spray devices 121; and the control device 11 including a plurality of controllers 112 each for controlling the row of spray devices 121 to control the spray sequence, the spray time, and the spray quantity of dye.

Conveying the dyed object 20 from the dyeing apparatus 12 to a vapor device 14 for color fixing wherein the dyed object 20 is impregnated with vapor of 110-160° C. in the vapor device 14 for 5-10 minutes to obtain a finished object.

Figure 4:
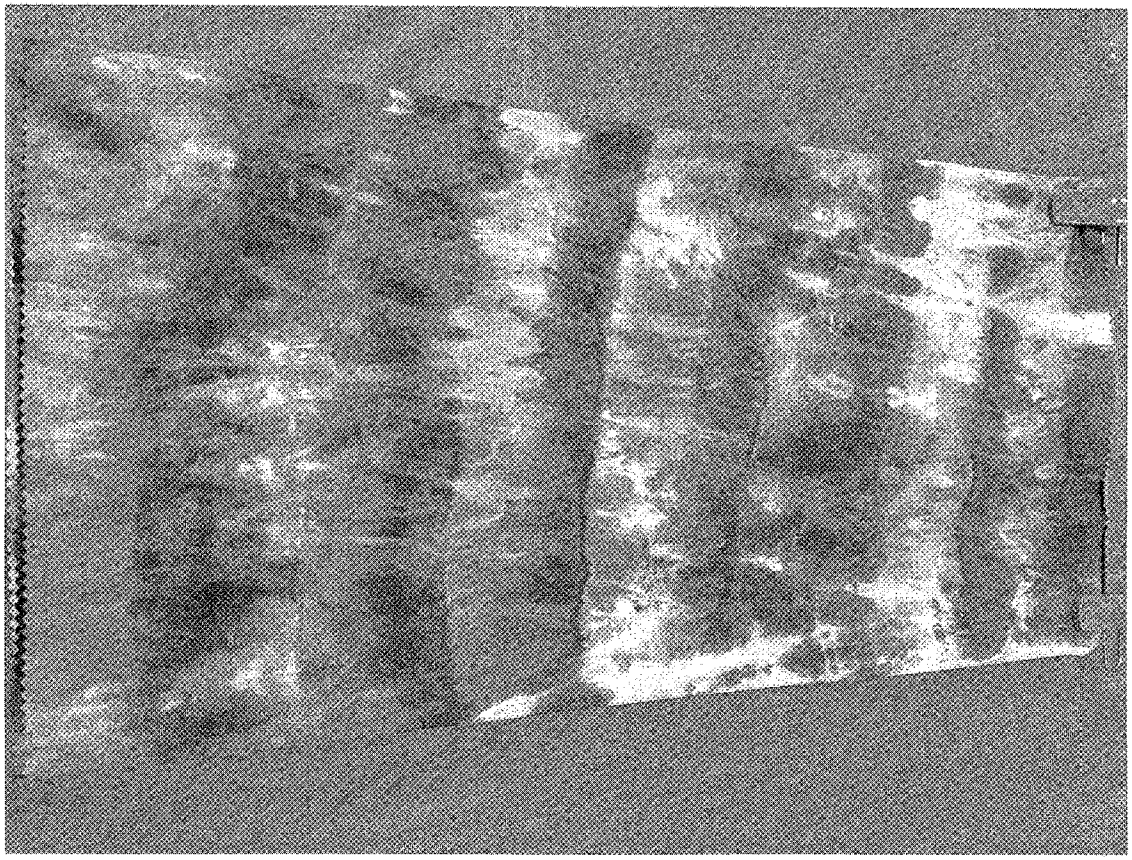
FIG. 4 is a photograph of pieces of first fabric dyed by the dyeing process of the invention.
Figure 5:
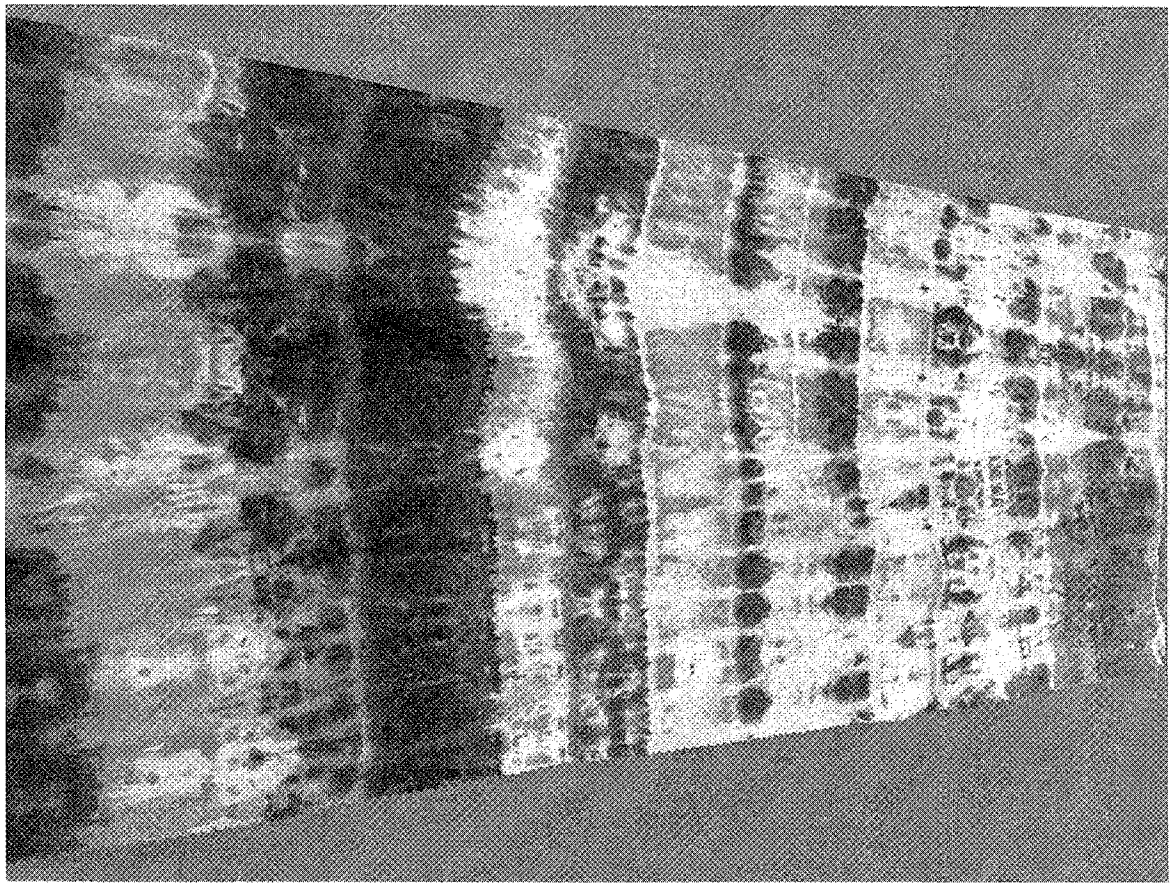
FIG. 5 is a photograph of pieces of second fabric dyed by the dyeing process of the invention.

Conveying the finished object to a tie ropes removing device 36 to cut the tie ropes 341 wherein the previously tied portions of the finished object will not be dyed, thereby rendering the finished object have different textures after the cut (see FIGS. 4 and 5).

Conveying the finished object to a temporary storage device 16.

Washing the finished object with a washing device to remove dyes left on the surfaces of the finished object.

Drying the cleaned, finished object to obtain a finished object.

The conveyor 10 may be provided with a belt or a plurality of two opposing rollers.

Figure 2:
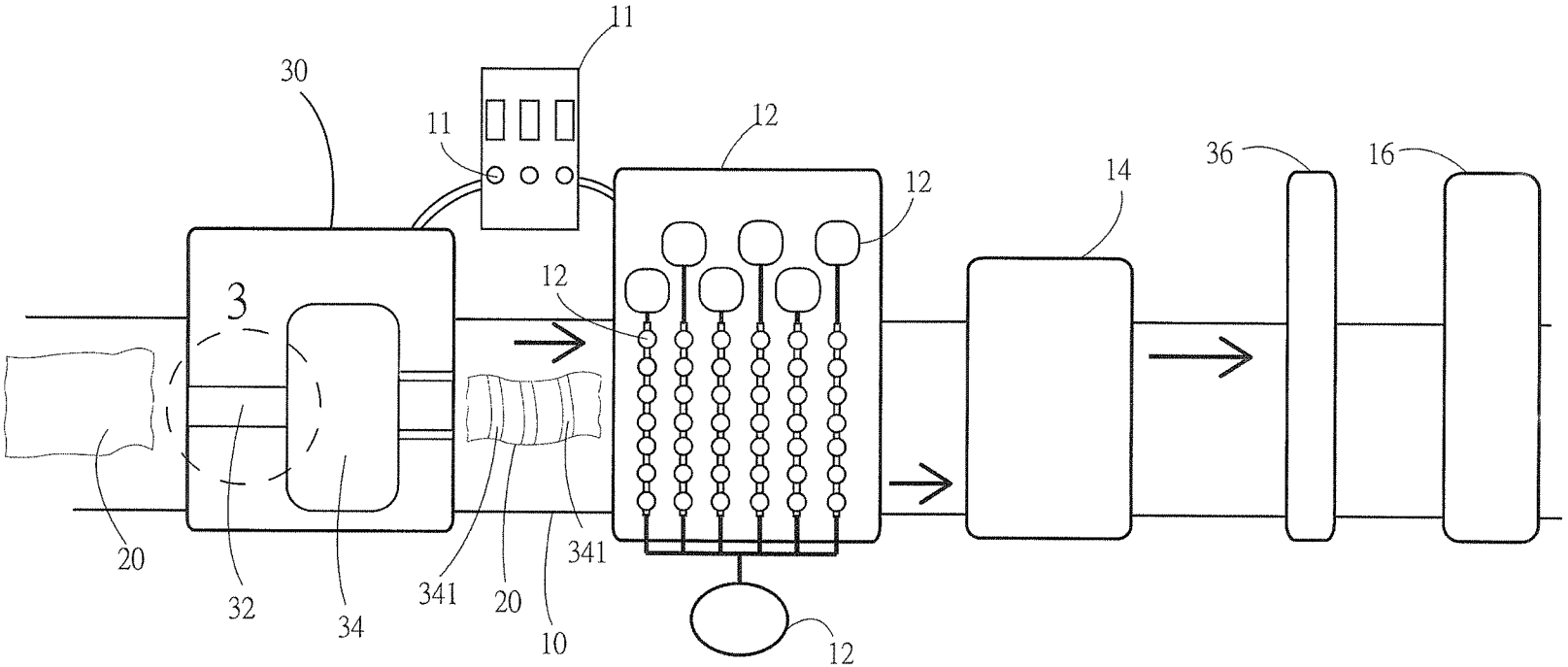
FIG. 2 schematically depicts a dyeing apparatus according to the invention, the dyeing process being tied to the dyeing apparatus.
Figures 3, 3A, 3B:
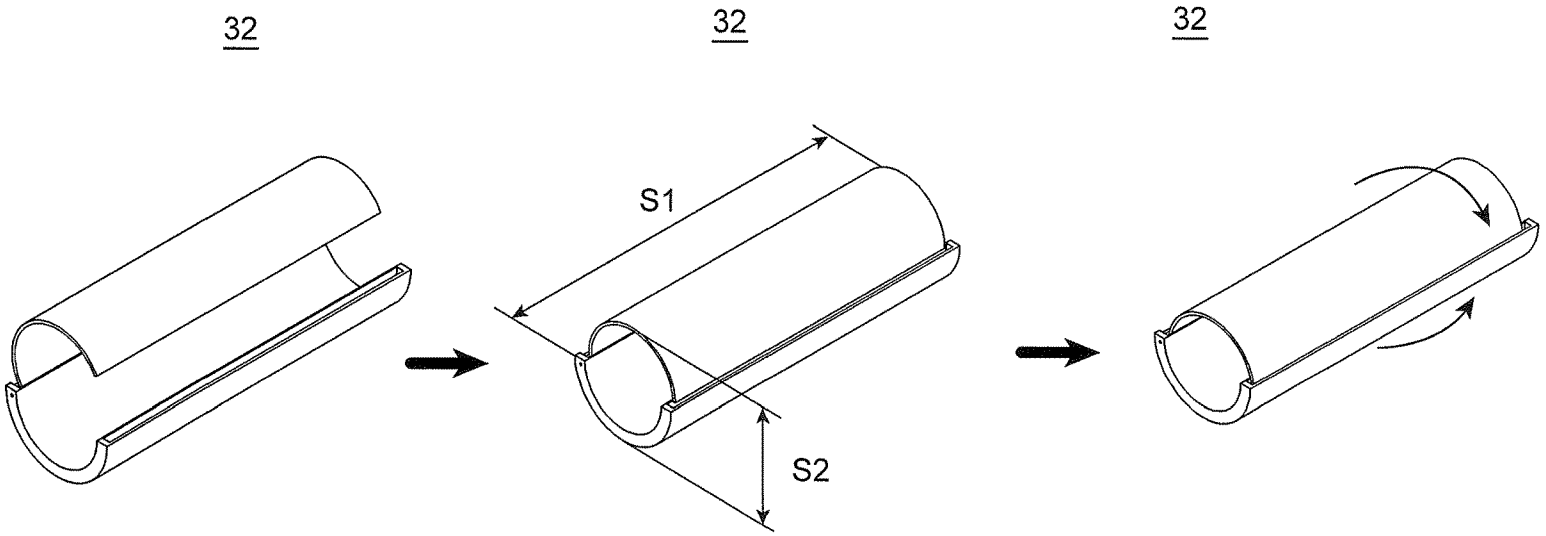
FIG. 3 is a perspective view of the spooling device being open.
FIG. 3A is a perspective view of the spooling device being closed.
FIG. 3B is a view similar to FIG. 3A showing a decrease of the diameter.

As shown in FIGS. 2, 3A and 3B, the spooling device 32 may be flexed to adjust its diameter. Length 51 of the spooling device 32 is 30 cm and diameter S2 thereof is between 5 and 30 cm. Shape of the undyed object 20 can be limited by adjusting the diameter S2. Thus, patterns of the undyed object 20 may have differences along a longitudinal direction after has been sprayed.

Preferably, the undyed object 20 is one of strands of yarn, pieces of fabric, and garments.

Preferably, length from the dyeing apparatus 12 to the temporary storage device 16 via the vapor device 14 along the conveyor 10 is in the range between 15-20 meters.

Preferably, the number of the rows of spray devices 121 is six, the rows of spray devices 121 are spaced apart by a predetermined distance, and the distance is adjustable by the control device, and each row of spray devices 121 has seven spray devices 121.

It is envisaged by the invention that different colors can be dyed on the object to form different patterns thereon in one dyeing process.

The dyed fabric shown in FIGS. 4 and 5 are for illustrating the dyeing process of the invention not for limiting the dyeing process of the invention to be applicable to fabric.

While the invention has been described in terms of preferred embodiments, those skilled in the art will recognize that the invention can be practiced with modifications within the spirit and scope of the appended claims.

What is claimed is:

1. An automatic color mix dyeing process comprising the steps of:

activating an automatic shaping device to shape an undyed object as a cylinder and tightening same wherein the automatic shaping device has a spooling device configured to open or close and an automatic tying device;

opening the spooling device to place the undyed object therein;

passing the undyed object through the spooling device to shape as a cylinder;

conveying the undyed object to the automatic tying device by a conveyor wherein the automatic tying device has a plurality of tie ropes controlled by a control device to tie the cylindrical undyed object in different intervals;

conveying the shaped undyed object to a dyeing apparatus for dyeing by means of spraying wherein the dyeing apparatus includes a plurality of rows of spray devices, a plurality of dye containers for containing dyes of different colors, each dye container being in fluid communication with the row of spray devices, a pump for moving the dyes in the dye containers to the rows of spray devices, and the control device for controlling the rows of spray devices to control a spray sequence, a spray time, and a spray quantity of dye;

conveying the dyed object from the dyeing apparatus to a vapor device for color fixing wherein the dyed object is impregnated with vapor of 110-160° C. in the vapor device for 5-10 minutes to obtain a finished object;

conveying the finished object to a tie ropes removing device to cut the tie ropes; and conveying the finished object to a temporary storage device;

wherein the plurality of rows of spray devices of the dyeing apparatus are able to simultaneously spray and dye on the undyed object to form multiple color mix patterns thereon in one dyeing process.

2. The automatic color mix dyeing process of claim 1, wherein after the step of conveying the finished object to a temporary storage device, further comprises the steps of washing and drying the finished object.

3. The automatic color mix dyeing process of claim 2, wherein the washing step is done by washing the finished object with a washing device to remove dyes left on surfaces of the finished object.

4. The automatic color mix dyeing process of claim 1, wherein the spooling device is configured to adjust its diameter by flexing to limit a shape of the undyed object passing through, and wherein the diameter is between 5 and 30 cm.

5. The automatic color mix dyeing process of claim 1, wherein the spooling device is cylindrical and configured to open.

6. The automatic color mix dyeing process of claim 1, wherein the tie ropes are of different shapes and wound around the undyed object in different intervals, and wherein the intervals are between 5 and 20 cm.

7. The automatic color mix dyeing process of claim 1, wherein a width of each of the tie ropes is between 5 and 10 cm.

8. The automatic color mix dyeing process of claim 1, wherein the undyed object is one of strands of yarn, pieces of fabric, and garments.

9. The automatic color mix dyeing process of claim 1, wherein the control device includes a plurality of controllers, each for controlling the row of spray devices to control the spray sequence, the spray time, and the spray quantity of dye.

10. The automatic color mix dyeing process of claim 1, wherein the number of the rows of spray devices is six, and each row of spray devices has seven spray devices.

11. The automatic color mix dyeing process of claim 1, wherein a length from the dyeing apparatus to the temporary storage device via the vapor device along the conveyor is in the range between 15-20 meters.

12. The automatic color mix dyeing process of claim 1, wherein the rows of spray devices are spaced apart by a predetermined distance, and the distance is adjustable by the control device.

13. The automatic color mix dyeing process of claim 1, wherein the conveyor is provided with a belt or a plurality of two opposing rollers.

* * * * *